US005913656A

United States Patent [19]

Collins

[11] Patent Number: 5,913,656

[45] Date of Patent: Jun. 22, 1999

[54] METHOD AND APPARATUS FOR MERGING SHINGLED SIGNATURE STREAMS

[76] Inventor: Michael A. Collins, 6032 Willow Wood La., Dallas, Tex. 75252

[21] Appl. No.: 08/970,300

[22] Filed: Nov. 14, 1997

[51] Int. Cl.[6] ..... B65G 59/00; B65H 5/26

[52] U.S. Cl. ..... 414/801; 414/789.6; 414/901; 271/9.01; 271/9.13

[58] Field of Search ..... 235/475, 479, 235/486; 414/789.6, 789.9, 789.8, 790.7, 791.2, 901, 271, 198, 801; 271/9.01, 9.13, 151, 216; 198/460.1, 460.3

[56] References Cited

U.S. PATENT DOCUMENTS

| | | | |
|---|---|---|---|
| 2,548,767 | 4/1951 | Brest | 414/789.9 |
| 3,698,707 | 10/1972 | Lucas | 414/789.8 |
| 3,880,421 | 4/1975 | Muller | 414/791.2 |
| 3,924,845 | 12/1975 | Wise et al. | 270/54 |
| 3,978,571 | 9/1976 | Orlando et al. | 414/789.6 |
| 4,311,475 | 1/1982 | Imai | 414/901 |
| 4,684,116 | 8/1987 | Hansch | 270/54 |
| 4,696,464 | 9/1987 | Gammerler | 271/202 |
| 5,022,644 | 6/1991 | Burge | 198/460.3 |
| 5,028,192 | 7/1991 | Lindsay et al. | 412/1 |
| 5,098,075 | 3/1992 | Lindblom | 270/54 |
| 5,292,110 | 3/1994 | Honegger | 270/55 |
| 5,503,382 | 4/1996 | Hansen et al. | 271/9.01 |
| 5,584,472 | 12/1996 | Hidding et al. | 271/3.06 |

*Primary Examiner*—H. Grant Skaggs
*Assistant Examiner*—Joe Dillon, Jr.
*Attorney, Agent, or Firm*—Dennis T. Griggs

[57] ABSTRACT

Two shingled streams of signatures are stacked independently of each other in separate stacking bins that are aligned vertically one above the other and also vertically aligned with the collection bin of a re-feeder. The collection bin is replenished periodically by stopping the shingled streams and unloading the contents of the lower and upper stacking bins to form a combined stack of signatures in the re-feeder collection bin. Signatures in the re-feeder collection bin are delivered by an out-feed conveyor belt in a single reshingled stream of signatures to an in-line processing station. In an alternative embodiment, the stacking bins are laterally separated with respect to each other for separately stacking signatures from two incoming shingled streams that are being output from separate web presses or other independent sources. The incoming signatures are separately stacked and the stacks are periodically unloaded onto separate stacking tables on laterally opposite sides of a common re-feeder. The signature stacks are separately delivered at different times into the re-feeder collection bin, thereby forming a combined stack of signatures that are subsequently reshingled into a single running stream.

11 Claims, 7 Drawing Sheets

METHOD AND APPARATUS FOR MERGING SHINGLED SIGNATURE STREAMS

BACKGROUND OF THE INVENTION

The present invention relates generally to apparatus for handling and transporting folded sheet material, and in particular to method and apparatus for merging two shingled signature streams into a single running output stream for transport to an inline processing station.

In the operation of a web-fed offset or rotogravure printing press of the type used for printing newspaper inserts, magazines, booklets and the like, a printed web is fed into a folder at the delivery end of the press where it is folded, cut, slit and output in an overlapping assembly of identical folded items, thereby forming a running shingle. Each folded item is referred to as a "signature" and the overlapping signatures are said to be "shingled". In a running shingle, the signatures partially overlap, with the folded edge of trailing signatures being set back with respect to the folded edge of the leading signatures.

As the running shingle exits from the folder, the shingled signatures are transported by a conveyor belt to an inline processing station where various finishing operations are performed. Examples of such finishing operations include trimming at a rotary trimmer; attaching address labels at a labeling machine; and, stacking signatures in bundles for delivery to a bulk mailing station, or for delivery to a newspaper or magazine vendor, or for temporary storage awaiting further assembly with freshly printed signatures in a saddle stitching and perfect binding machine.

The folders of most modern web presses incorporate a slitting wheel which slits the printed web, forming two or more ribbons that are fed into the folder, where they are folded and a rotary knife cuts the folded ribbons. The ribbons may be folded in various forms, i.e. half-folded and quarter-folded signatures. The folder delivers the folded signatures to a folder delivery where they are output in two or more shingled signature streams. Each shingled stream is then separately conveyed, either one elevated above the other or one laterally offset from the other, to separate in-line finishing stations.

Moreover, in some installations, two web presses are operated side-by-side, each producing a shingled stream of signatures, with the singles being transported along parallel conveyors to separate in-line finishing stations. Consequently, press operators have found it necessary to provide duplicate finishing units requiring a large expenditure for capital equipment, with the duplicate finishing units occupying duplicate floor space areas and requiring duplicate crews to perform finishing operations at the separate finishing stations.

It will be appreciated that production costs could be reduced substantially by merging the separate product streams into a single output stream for subsequent processing by one crew at a single in-line processing station. Various proposals have been made for handling multiple streams of signatures so that a single running stream of signatures is presented for subsequent processing.

For example, Gammerler U.S. Pat. No. 4,696,464 discloses a method of merging two shingled product streams and delivering them as a single stream of shingled product. Gammerler's method requires that the movement of shingles in an upper product stream be synchronized with the movement of shingles in a lower product stream, whereby shingles from the upper product stream can be ejected onto signatures in the lower product stream.

Hansch U.S. Pat. No. 4,684,116 discloses method and apparatus for collating signatures having three conveyors of signatures that are input to a rotating, collating drum which feeds the signatures to a single conveyor. The signatures are re-shingled by a withdrawal conveyor into a single output stream.

Honegger U.S. Pat. No. 5,292,110 discloses method and apparatus for handling multiple streams of signatures in series or in parallel. A revolving endless conveyor combines two or more streams of printed items into a single running shingle for subsequent processing.

Lindblom U.S. Pat. No. 5,098,075 discloses a stream of signatures that are spaced and diverted to one of two impeller wheels that deliver signatures to a single stack. The signatures are combined as desired including two different partial inner books made up from assembled signatures.

One limitation on the use of conventional merging units is the requirement for synchronization or isochronous coordination of shingles in two or more product streams. This generally requires considerable additional construction and equipment costs, as well as being difficult to achieve in actual practice, particularly in view of the difficulty of synchronizing equipment operation and shingle movement at high operating speeds. Further difficulties arise where the shingled signature streams are being output at different feed rates from separate sources. Consequently, there is a continuing interest in providing method and apparatus for merging two independent signature streams into one shingled output stream for further processing in a single finishing unit.

BRIEF SUMMARY OF THE INVENTION

Two shingled streams of signatures, delivered from a dual delivery press or from independent sources, are stacked independently of each other in separate stacking bins. The stacks are periodically unloaded into the collection bin of a re-feeder. The amount of signatures in at least one of the stacking bins is monitored and the shingled streams are momentarily stopped in response to the build-up of a predetermined stack size or the accumulation of a predetermined number of signatures. The signature stacks are then unloaded into the re-feeder collection bin, and shortly after the signatures have settled, the delivery of signatures into the separate stacking bins is resumed. Signatures in the collection bin of the re-feeder are delivered by an out-feed conveyor belt in a single running stream of re-shingled signatures to an inline processing unit.

In the preferred embodiment, the stacking bins are aligned vertically one above the other, and are also vertically aligned with the collection bin of the re-feeder. The bins are separated from each other by a pair of retractable gates. Signatures from the separate streams accumulate in separate stacks on the support gates, and the stacks are unloaded into the re-feeder bin by gravity free-fall upon retraction of the support gates. By this arrangement, the re-feeder collection bin is replenished periodically by stopping the shingled streams momentarily and dropping the contents of the lower and upper stacking bins through the vertically aligned chambers to form a combined stack of signatures in the re-feeder collection bin.

In an alternative embodiment, the stacking bins are not in vertical alignment with each other, but instead are laterally separated for receiving shingles from two incoming shingled streams that are being output from independent sources, for example from two web presses or from two re-feeder units. In this lateral embodiment, the incoming shingles are separately stacked and the stacks are periodically dropped onto separate stacking tables in separate transfer stations.

The stacks are then moved onto separate exit conveyor belts for delivery into the collection bin of a common re-feeder. Staggered delivery of the separate stacks into the collection bin is coordinated by a pair of product level sensors that inhibit simultaneous operation of the delivery conveyors. By this arrangement, the product stacks are delivered separately and at different times into the re-feeder collection bin, thereby allowing sufficient time for signatures in the first stack to drop and settle before the second stack is unloaded.

BRIEF DESCRIPTION OF THE DRAWINGS

The accompanying drawing is incorporated into and forms a part of the specification to illustrate the preferred embodiments of the present invention. Throughout the drawing, like reference numerals designate corresponding elements. This drawing, together with the description, serves to explain the principles of the invention and is only for the purpose of illustrating exemplary embodiments showing how the invention can best be made and used. The drawing should not be construed as limiting the invention to the illustrated and described embodiments. Various advantages and features of the invention will be understood from the following detailed description taken in connection with the appended claims and with reference to the attached drawing in which:

DETAILED DESCRIPTION OF THE INVENTION

Figure 1:
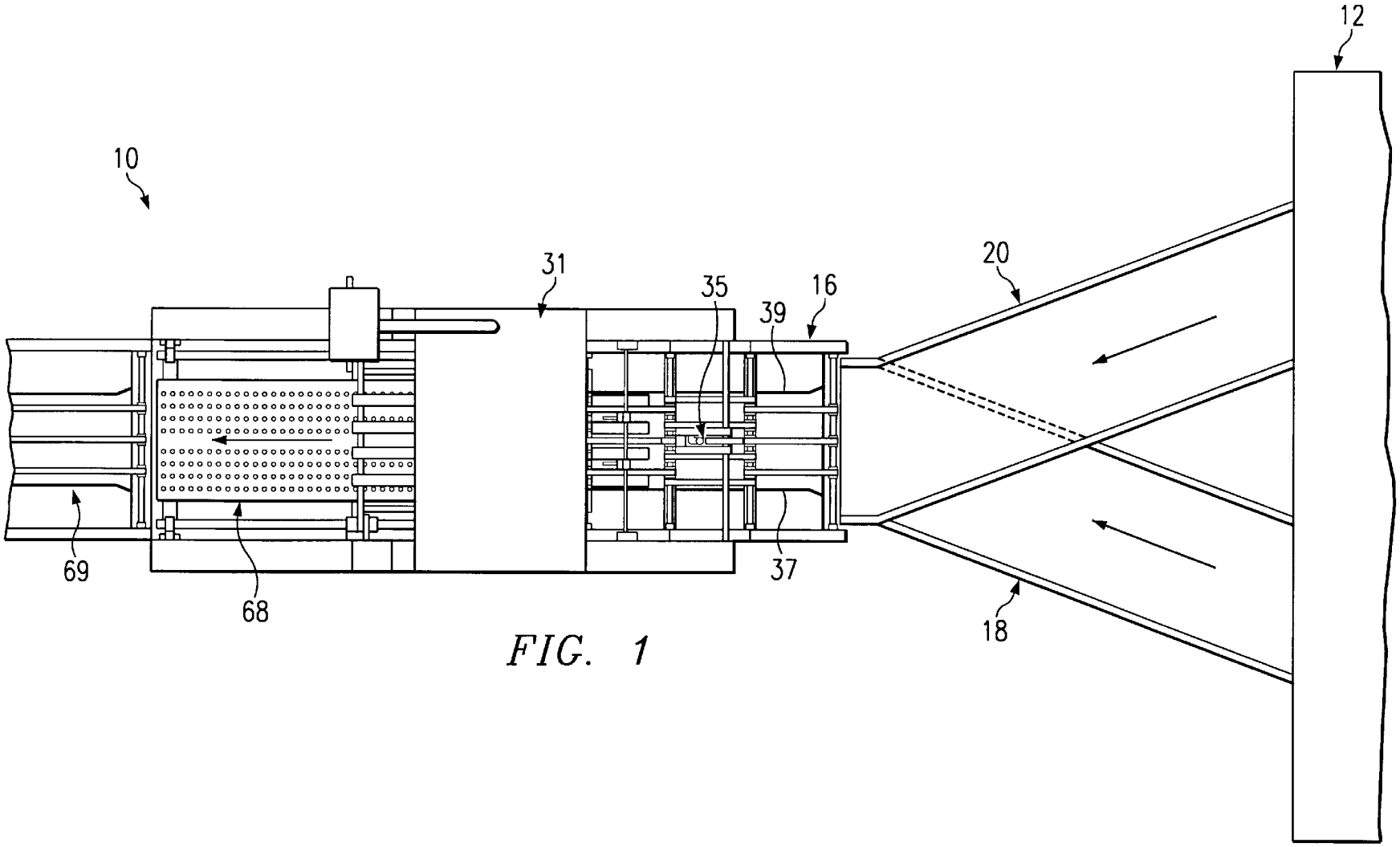
FIG. 1 is a top plan view of a dual stream merging unit constructed according to the present invention.

Presently, preferred embodiments of the invention are described herein by referring to various examples of how the invention can be made and used. Like reference numerals are used throughout the description and several views of the drawing to indicate like or corresponding parts.

Figure 2:
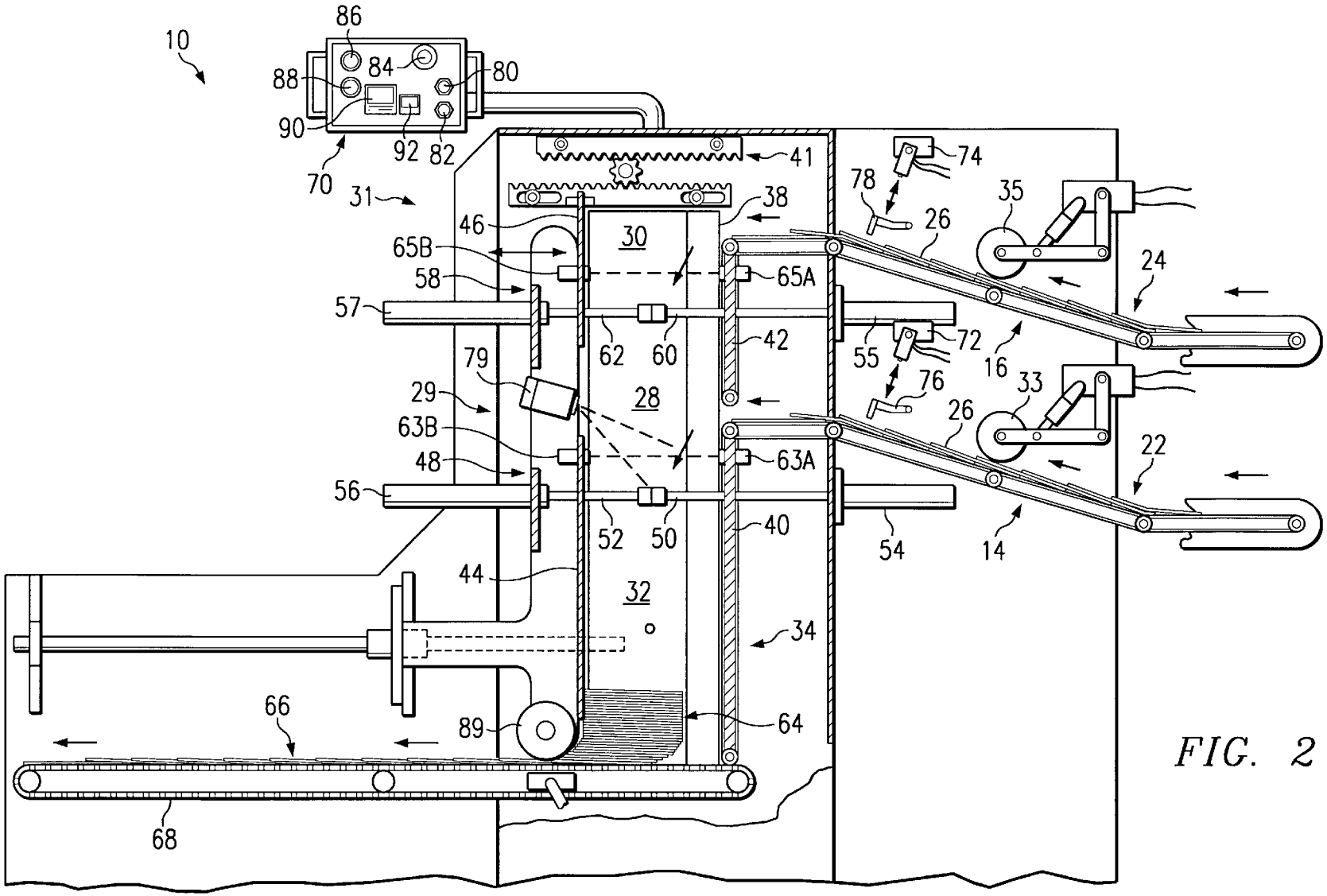
FIG. 2 is a side elevational view thereof, partially broken away.

Referring now to FIG. 1 and FIG. 2, a dual stream merging unit 10 constructed according to a first embodiment of the present invention is coupled to a double delivery folder 12 at the delivery end of a web-fed offset printing press (not illustrated). The dual stream merging unit 10 is equipped with a lower input conveyor 14 and an upper input conveyor 16. The lower and upper input conveyors are aligned with delivery feed conveyors 18, 20, respectively, which transport lower and upper shingled streams 22, 24 that are being output from the double delivery folder 12.

Figure 7:
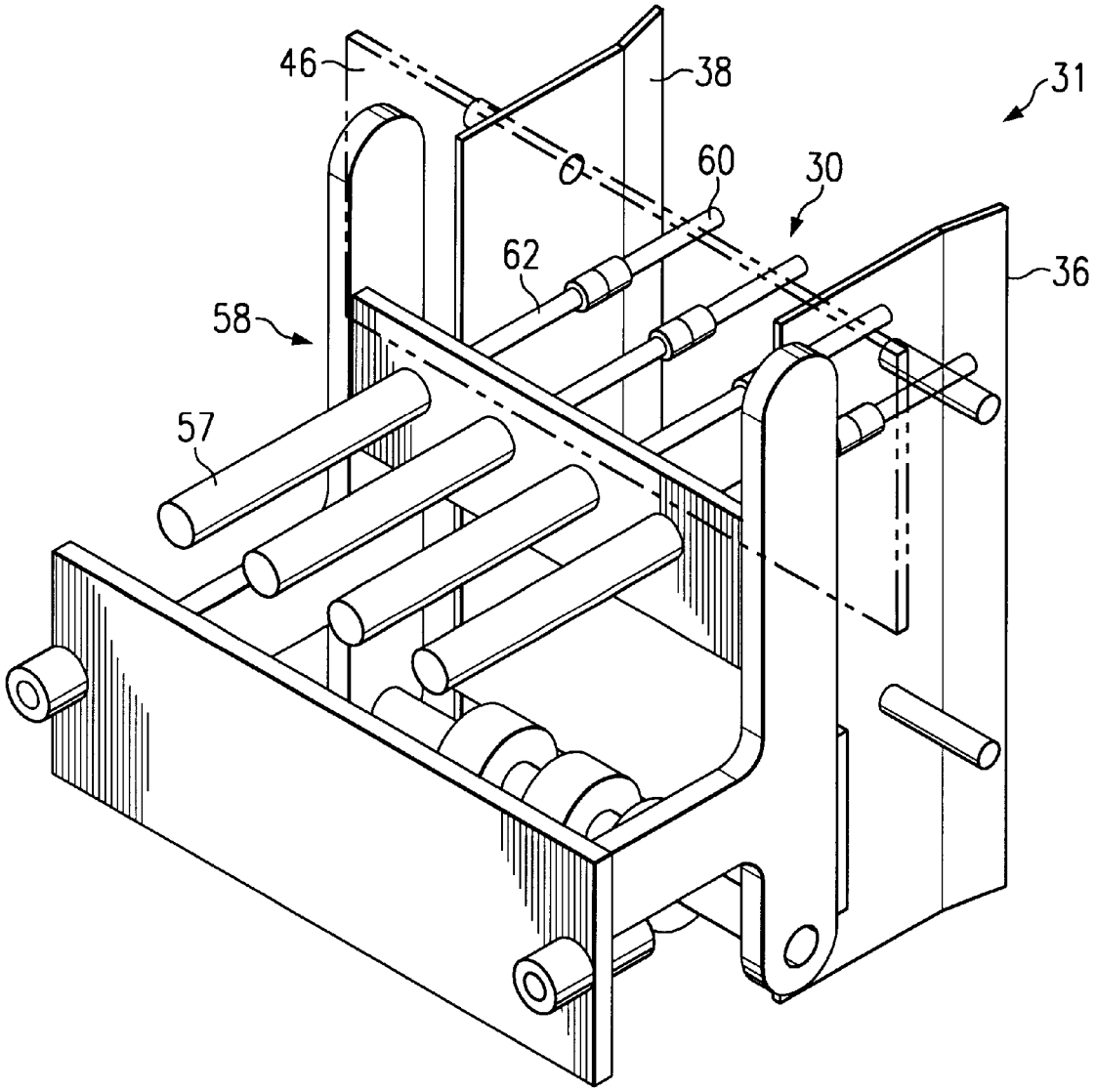

The upper running shingle 24 is diverted along the upper conveyor 16 of the stream merging unit and the lower running shingle 22 is diverted along the lower conveyor 14. The lower running shingle 22 is input into a stacking chamber 28 of a lower stacking bin 29, while the upper running shingle 24 is input into a stacking chamber 30 of an upper stacking bin 31. The signatures are maintained in running alignment within each shingle by hold-down rollers 33, 35 and by side paddle joggers 37, 39. Common construction details of the lower and upper stacking bins are illustrated in FIG. 7.

The paddle joggers 37, 39 assist alignment of signatures in the shingle stream before it enters the stacking bins 28, 30. The front and rear jogging panels are adjustable simultaneously by a gear and pinion assembly 41. The side jogging panels are also adjusted the same way, and operate independently of the front and back jogging panels.

Figure 3:
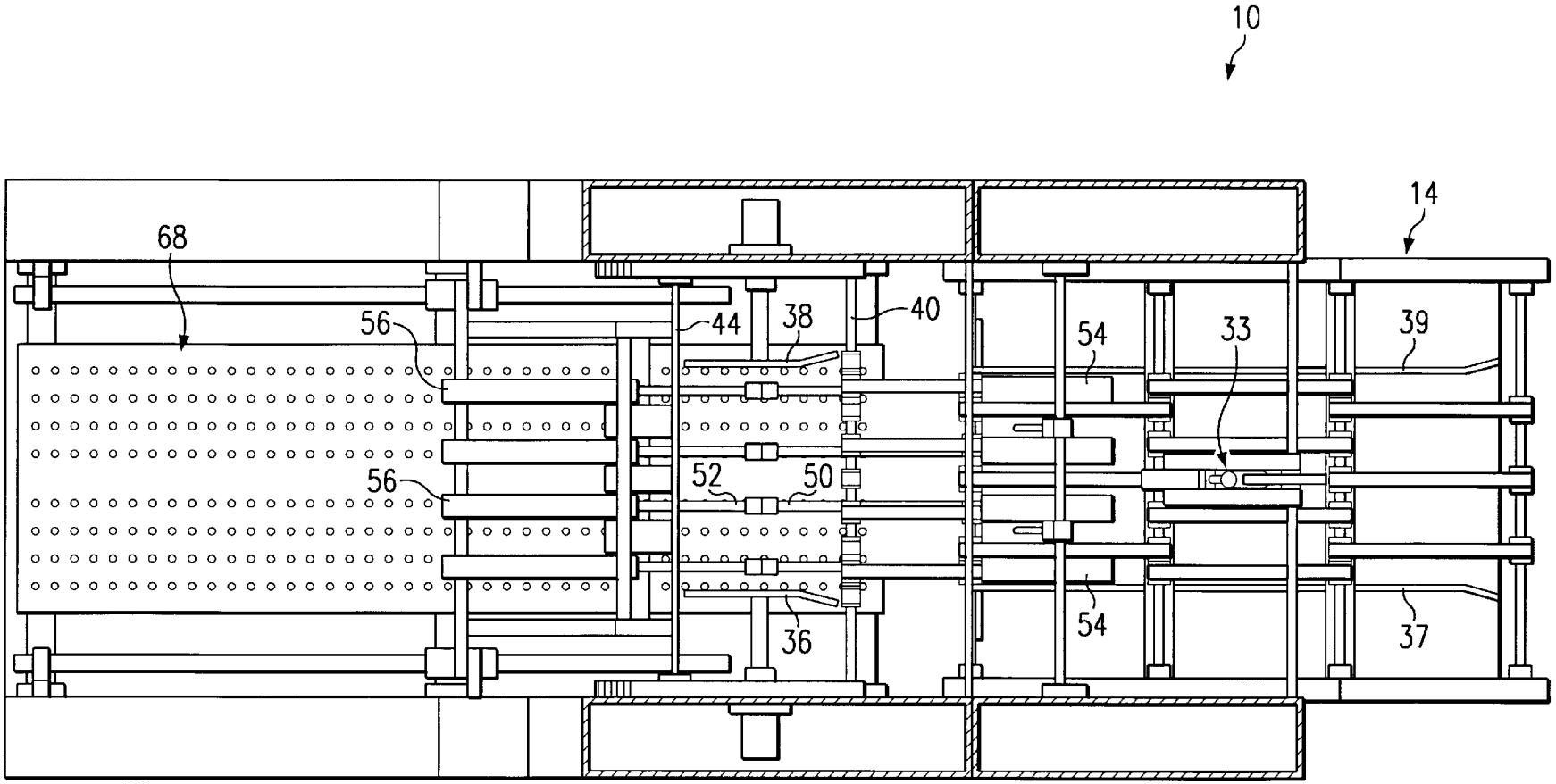
FIG. 3 is a top plan view thereof, with the top panels removed, and partially in section.

Referring to FIG. 2 and FIG. 3, the lower and upper stacking chambers 28, 30 are in vertical alignment with each other and are in vertical alignment with a collection bin 32 of a re-feeder assembly 34. The stacking chambers and the re-feeder collection bin are bounded by side jogger panels 36, 38 and by front jogger panels 40, 42 and rear jogger panels 44, 46. The jogger panels maintain flush alignment of the signatures within the chambers in which they are stacked.

The collection bin 32 of the re-feeder 34 is separated from the lower stacking bin 28 by a retractable gate assembly 48 that includes multiple finger segments 50, 52 that are extendable into engagement with each other, as shown in FIG. 2 and FIG. 3, and which are also retractable with respect to each other to open a drop passage between the lower stacking bin 28 and the collection bin 32. The retractable gate assembly 48 provides a platform for accumulating a stack of signatures in the lower stacking chamber 28 when the fingers 50, 52 are extended into closed engagement with each other.

The finger segments 50, 52 are extended and retracted by pneumatic cylinders 54, 56, respectively. Operation of the pneumatic cylinders is coordinated by the master controller 70 whereby the fingers are extended (gate closed) and retracted (gate open) simultaneously with each other. Likewise, the upper stacking chamber 30 is separated from the lower stacking chamber 28 by a retractable gate assembly 58 that includes multiple finger segments 60, 62.

The retractable gate assembly 58 separates the lower stacking bin 28 with respect to the upper stacking bin 30, and provides a platform for accumulating a stack of signatures in the upper stacking bin 30. The finger segments 50, 52 are extended and retracted by pneumatic cylinders 55, 57 in response to control signals generated by the master controller 70. The finger segments are retractable with respect to each other to open a drop passage between the upper stacking bin 30 and the lower stacking bin 28.

Referring again to FIG. 2, the top shingled stream 24 enters the upper stacking bin 30, and builds a first stack of signatures on the upper retractable gate assembly 58. Simultaneously, the lower shingle 22 enters the lower stacking bin 28 and builds a second stack of signatures on the lower gate assembly 48 as the upper stack is building.

The separate stacks are squared-up by the vibrating jogger panels, and are built-up to a predetermined stack height that is monitored by stack level sensing means, for example by signature counting, by an optical beam or by an interval timer. In the arrangement shown in FIG. 2, the signature stack heights in the lower and upper chambers are monitored by photocell detectors 63A, 63B and 65A, 65B, respectively.

Simultaneously as the stacks are building in the lower and upper stacking bins, signatures in a stack 64 previously accumulated in the collection bin 32 of the re-feeder assembly 34 are re-shingled and delivered as a single running shingle 66 that is conveyed along an out-feed conveyor belt 68 to an inline transport conveyor 69.

The amount of signatures accumulated in either the lower stacking bin 28 or in the upper stacking bin 30 is monitored, and the shingle streams 22, 24 are momentarily stopped when a stack of a predetermined size in either bin has been detected, for example six to eight inches. The stack height or quantity of signatures accumulated in the stacking bin is detected by the photocell sensors, each providing an interrupt control signal to a master controller 70. The master controller 70 actuates a pair of solenoids 72, 74 which in turn extend a pair of stop fingers 76, 78 into the shingled streams 22, 24, respectively, thus momentarily stopping the delivery of signatures.

The controller 70 provides a short delay interval, for example one-half second, to allow the last few signatures to enter the stacking chambers 28, 30. Unload control signals are then applied to the pneumatic cylinders 54, 56 and 55, 57, causing retraction of the support rods 60, 62 of the upper gate assembly 58 and allowing the stack of signatures in the upper stacking chamber 30 to drop and free-fall onto the stack of signatures in the lower stacking chamber 28. After a short delay interval, for example one or two seconds, another control signal is applied to the pneumatic cylinders of the lower gate assembly 48, thus allowing the combined stacks to drop and unload into the re-feeder chamber 32.

An optical sensor 79 detects that the combined stack has cleared the lower gate assembly 48, and the controller 70 applies another control signal to extend the support rods to close both gates 48, 58. After the short delay interval, another control signal is applied to the solenoids 72, 74 which retract the stop fingers 76, 78, thus allowing the shingled streams 22, 24 to resume filling the lower and upper stacking bins 28, 30.

The outfeed conveyor 68 is a variable speed, vacuum-assisted belt that is continuously moving at an adjustable speed. A tachometer generator coupled to the web-fed printing press sends a proportional control signal to the drive motor of the outfeed conveyor 68 as the printing press speeds up or slows down, thus increasing and reducing the speed of the outfeed vacuum belt.

The master controller 70 includes a start switch 80, a momentary stop switch 82 and an emergency stop switch 84. A manual speed control unit 86 provides for operator over-ride 28 to increase or decrease the speed of the exit vacuum belt 68 so that the number of shingled signatures in the output stream 66 is substantially in balance with the number of shingled signatures entering on the input shingles 22, 24.

A manual speed control unit 88 provides for manual adjustment of the speed of an outfeed roller 89. The outfeed roller compresses and pulls the shingles 26 from the bottom of the refeeder stack 64 in cooperation with the vacuum belt 68 as they are reshingled. Meters 90, 92 display a signature count tally and elapsed run time, respectively.

Figure 4:
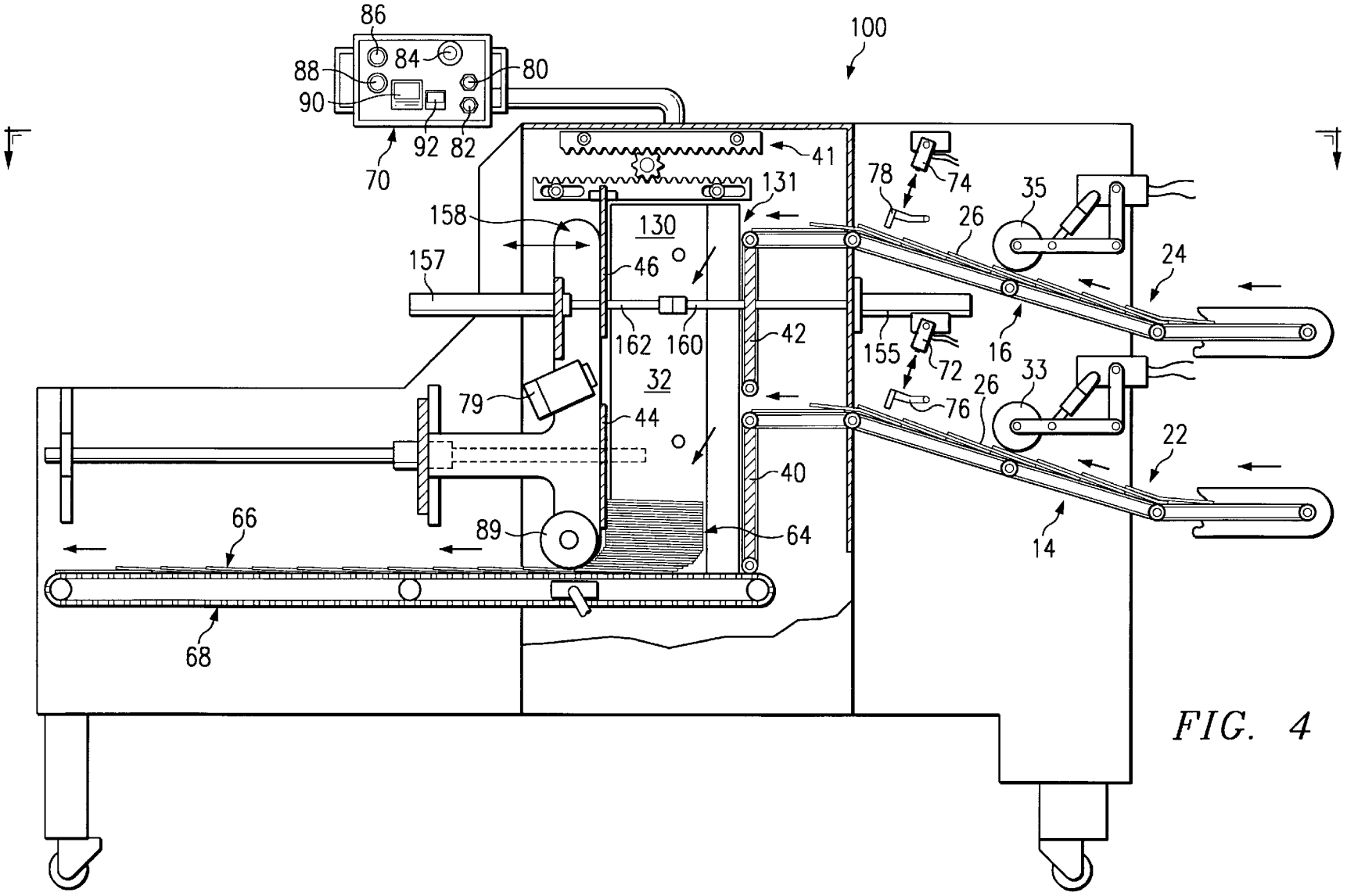
FIG. 4 is a side elevational view, partially broken away and partially in section, showing an alternative embodiment of a dual stream merging unit.

Referring now to FIG. 4, a dual stream merger unit 100 is constructed according to a first alternative embodiment of the invention. In this embodiment, an upper stacking bin 131 along with an upper gate assembly 158 are provided for temporarily accumulating signatures. An upper stacking chamber 130 is positioned in vertical alignment with the re-feeder bin 32, and includes the support fingers 160, 162 which separate the upper stacking chamber 130 from the re-feeder bin 32.

Signatures 26 accumulate on the platform provided by the extended, closed finger segments 160, 162 of the gate assembly 158. Simultaneously, signatures 26 transported by the lower input conveyor 14 in the shingle stream 22 are discharged directly into the re-feeder bin 32 and fall on top of signatures in the re-feed stack 64. Signatures are pulled from the stack 64 and are reshingled to form a single product stream 66 by the out-feed roller 89 and the out-feed conveyor 68 as signatures accumulate in the upper stacking chamber 130.

The amount of signatures accumulated in the upper chamber 130 is monitored, and the shingle streams 22, 24 are momentarily stopped when a stack of a predetermined size has accumulated in the upper stacking bin. The stack height or quantity of signatures accumulated in the stacking bin 131 is sensed by photocell detectors as described in connection with the principal dual stream merger embodiment 10 shown in FIG. 2, providing an interrupt control signal to the master controller 70. In response to the interrupt control signal, the master controller actuates the control solenoids 72, 74 which respond by extending the stop fingers 76, 78 into the shingled streams 22, 24, respectively, thus momentarily stopping the shingles and interrupting the delivery of signatures.

After a short delay interval, drop control signals are then applied to the pneumatic cylinders 155, 157 causing retraction of the support rod 160, 162 of the upper gate assembly 158 and allowing the stack of signatures in the upper stacking bin to drop and free-fall directly into the re-feeder stacking bin 32, thus replenishing the refeeder signature stack 64.

An optical sensor 79 detects that the signature stack in the upper chamber 130 has dropped, and the controller 70 responds by applying another control signal to extend the support rods to close the upper gate 158. After a short delay interval, another control signal is applied to the solenoids 72, 74 which respond by retracting the stop fingers 76, 78, thus permitting the single streams 22, 24 to resume filling the upper stacking bin and the refeeder bin.

Figure 5:
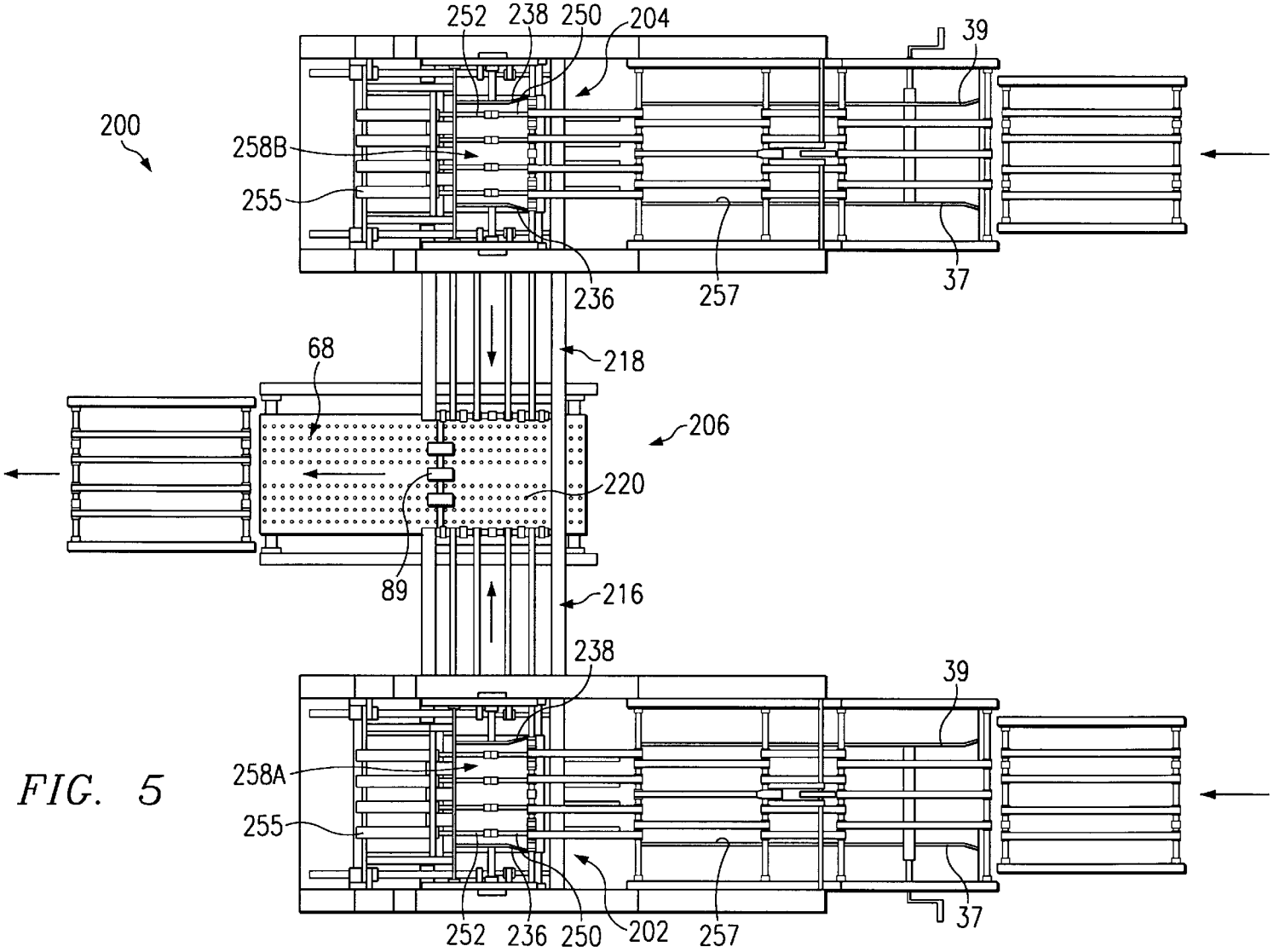
FIG. 5 is a top plan view of an alternative embodiment of a dual stream merging unit for merging separate shingled streams that are independently output from separate sources.
Figure 6:
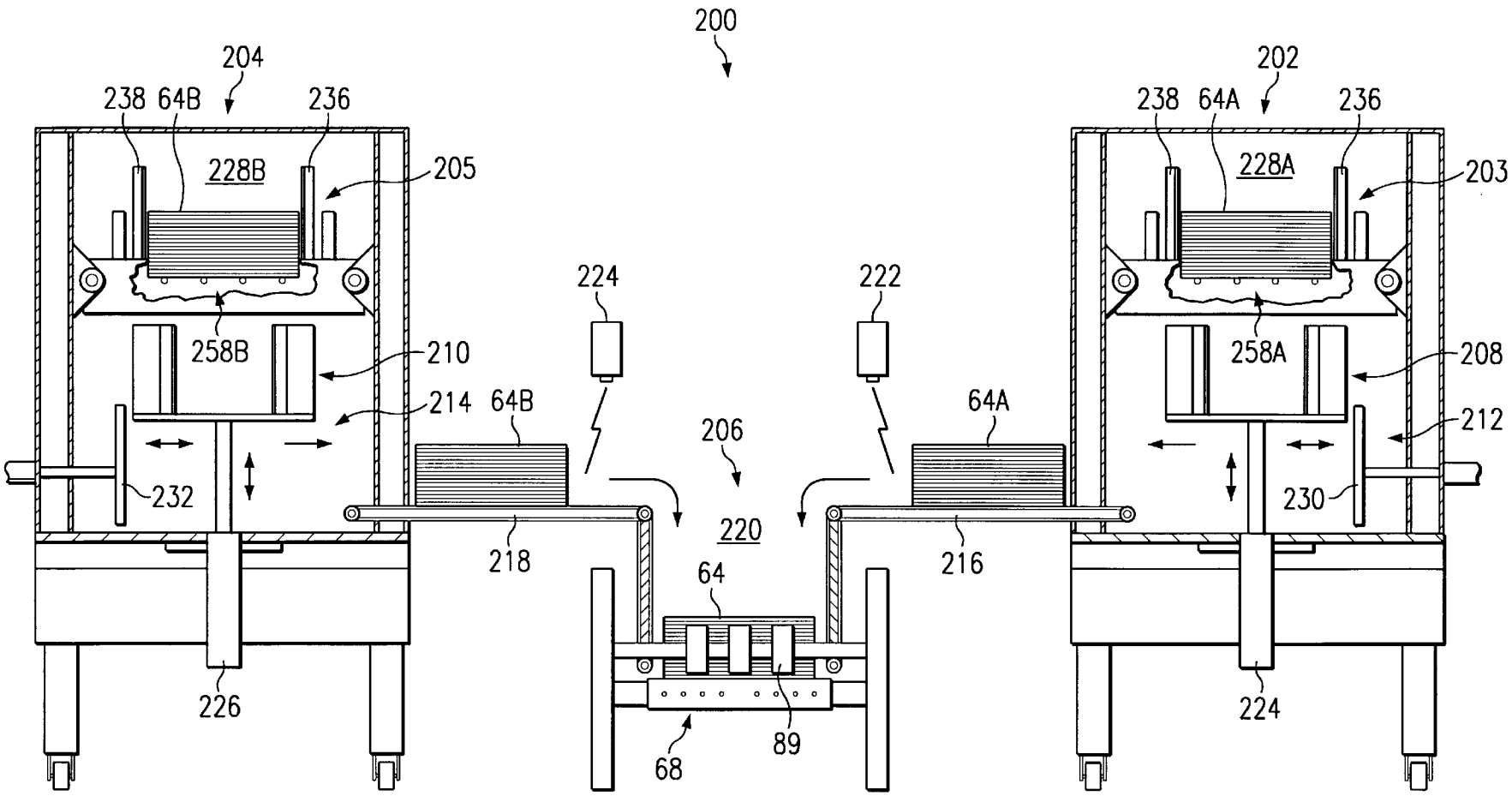
FIG. 6 is front elevational view thereof, partially in section and partially broken away; and, FIG. 7 is a perspective view of the stacking bin utilized in all embodiments of the invention.

Referring now to FIG. 5 and FIG. 6, a dual stream merger unit 200 is constructed to a second alternative embodiment of the invention. The dual stream merger unit 200 includes first and second stacking units 202, 204 and a central re-feeder 206. The stacking units are not in vertical alignment with each other, but instead are laterally separated for receiving shingles from two incoming shingled streams that are being output from independent sources, for example from two web presses or from two re-feeder units. In this lateral embodiment, the incoming signatures are accumulated in the stacking units 202, 204 and the stacks are periodically unloaded onto separate stacking tables 208, 210 in laterally separated transfer stations 212, 214.

Mounted near the top of each stacking unit are stacking bins 203, 205, respectively. The stacking bins are substantially identical in construction with the stacking bin 31 shown in FIG. 7. Jogging panels 236, 238 and extendable/retractable stack support segments 250, 252 which are mounted about support platforms 258A, 258B for separately accumulating the signature stacks 64A, 64B, respectively. The retractable gates 258A, 258B separate the stacking chambers 228A and 228B with respect to the stacking tables 208, 210, respectively.

The stacking tables 208, 210 are extendable and retractable in elevation by pneumatic cylinders 224, 226 which move the tables to an elevated receiving position adjacent the retractable gates 258A, 258B, as shown in FIG. 6, when extended. The pneumatic cylinders move the tables to a transfer position in which the stack tables are held in alignment with the conveyors 216, 218, respectively, when retracted. In the retracted position, the accumulated stacks 64A, 64B are in alignment with the conveyor belts 216, 218, respectively, for transfer out of the transfer stations 212, 214.

Signatures accumulate in the stacks 64A, 64B until a predetermined quantity has been accumulated in each bin.

The stacks 64A, 64B are unloaded independently of each other in response to output signals provided by product level sensors, for example the photocell sensors 65A, 65B shown in FIG. 2. The stacking chambers 228A and 228B are in vertical drop alignment with the stack tables 208, 210.

The amount of signatures accumulated in each stacking bin is monitored, and the shingle streams 22, 24 are momentarily stopped when a stack of a predetermined size has accumulated in the either stacking bin. The stack height or quantity of signatures accumulated is sensed by photocell detectors 65A, 65B as described in connection with the principal dual stream merger embodiment 10 shown in FIG. 2. The photocell sensors provide an interrupt control signal to the master controller 70. In response to the interrupt control signal, the master controller actuates the control solenoids 72, 74 which respond by extending the stop fingers 76, 78 into the shingled streams 22, 24, respectively, thus momentarily stopping the shingles and interrupting the delivery of signatures to both bins.

After a short delay interval, unload control signals are then applied to the pneumatic cylinders 255, 257 causing the support rods 60, 62 of the upper gate assembly 258 to retract, allowing the signature stacks 64A, 64B to drop and free-fall directly onto the stacking tables 208, 210.

An optical sensor 79 detects that the signature stacks have dropped, and the controller 70 responds by applying another control signal to extend the support rods to close the gates 258A, 258B. After a short delay interval, another control signal is applied to the solenoids 72, 74 which respond by retracting the stop fingers 76, 78, thus permitting the single streams 22, 24 to resume filling the stacking bins. The stacks 64A, 64B are then transferred onto separate exit conveyor belts 216, 218 for delivery into the collection bin 220 of a centrally located, common re-feeder 206. Staggered or alternate delivery of the separate stacks into the refeeder collection bin 220 is coordinated by a pair of product level sensors 222, 224 that inhibit simultaneous operation of the delivery conveyors. By this arrangement, the product stacks are delivered separately and at different times into the re-feeder collection bin, thereby permitting signatures in the first stack 64A to drop and settle before the second stack 64B is unloaded.

The stacking bins 202, 204 are laterally separated with respect to each other for separately stacking shingles from two incoming shingled streams that are being output from separate web presses or from other independent sources. The incoming shingles do not require synchronization or isochronous handling of signatures. The shingles can be fed at different rates. For example, one incoming stream could be delivered from a web-fed offset press at 90,000 signatures per hour, while the second incoming stream could be delivered from a temporary storage re-feeder at 15,000 signatures per hour.

The incoming shingles are separately stacked and the stacks are periodically unloaded onto the separate stacking tables 208, 210 on laterally opposite sides of the central re-feeder 206. Pushers 230, 232 engage the signature stacks 64A, 64B and push them onto the conveyors 216, 218 in response to a control signal applied by the controller 70. The signature stacks are separately delivered at different times into the re-feeder collection bin 220, thereby forming a combined stack 64 of signatures that are subsequently reshingled into a single running stream by an outfeed conveyor 268 and an outfeed roller 289.

Although the invention has been described with reference to certain exemplary arrangements, it is to be understood that the forms of the invention shown and described are to be treated as preferred embodiments. Various changes, substitutions and modifications can be realized without departing from the spirit and scope of the invention as defined by the appended claims.

I claim:

1. A process for merging first and second incoming shingled streams of signatures into a single outgoing shingled stream, comprising the steps of:

(a) providing a re-feeder including a collection bin for receiving a stack of signatures and an out-feed conveyor belt for delivering a single outgoing stream of shingled signatures to an in-line processing station;

(b) providing a first stacking bin having a chamber for accumulating a stack of signatures;

(c) providing a second stacking bin having a chamber for accumulating a stack of signatures;

(d) delivering a first shingled stream of signatures into the first stacking bin thereby accumulating a first stack of signatures therein;

(e) delivering a second shingled stream of signatures into the second stacking bin thereby accumulating a second stack of signatures therein;

(f) sensing the amount of signatures accumulated in either the first stacking bin or in the second stacking bin;

(g) interrupting delivery of signatures into the first and second stacking bins in response to the sensed amount in either the first stacking bin or in the second stacking bin reaching a predetermined value;

(h) unloading the contents of the first and second stacking bins into the re-feeder collection bin to form a combined stack of signatures in the collection bin; and, (i) resuming delivery of signatures into the first and second stacking bins, respectively.

2. The process of claim 1 further including:

adjusting the speed of the outfeed conveyor belt by decreasing the speed of the conveyor belt if the stack amount is below a lower accumulated amount and increasing the conveyor belt speed if the monitored stack amount is above an upper accumulated amount, thereby maintaining the input and output of signatures to and from the re-feeder substantially in balance.

3. The process of claim 1 wherein the sensing step is performed by detecting the elapse of a predetermined time interval while the shingles are being stacked.

4. The process of claim 1 wherein the sensing step is performed by counting the signatures delivered into one of the stacking bins until the count reaches a predetermined number.

5. The process of claim 1, further including:

directing an optical beam across the accumulation chamber of either the first stacking bin or the second stacking bin; and, the sensing step is performed by detecting interruption of the optical beam.

6. A process for combining at least two incoming shingled streams of signatures into a single outgoing shingled stream, comprising the steps of:

(a) providing a re-feeder including a collection bin mounted over a variable speed outfeed belt for outputting a single stream of shingled signatures;

(b) providing a first stacking bin above and in drop alignment with the re-feeder collection bin, and separating the first stacking bin from the re-feeder collection bin by an extendable and retractable stack support member;

(c) providing a second stacking bin above and in drop alignment with the first stacking bin, and separating the second stacking bin from the first stacking bin by an extendable and retractable stack support member;

(d) delivering a first shingled stream into the first stacking bin to form a first stack of signatures;

(e) delivering a second shingled stream of signatures into the second stacking bin to form a second stack of signatures;

(f) sensing the amount of signatures accumulated in at least one of the stacking bins;

(g) interrupting the delivery of signatures from the first and second shingled streams when the sensed amount of signatures reaches a predetermined value;

(h) unloading the stacked signatures by opening the stack support members of the first and second stacking bins to permit the stacks to drop into the re-feeder collection bin;

(i) operating the outfeed belt to remove signatures from the bottom of the signature stack in the collection bin; and, (j) closing both stack support members and then resuming delivery of signatures from the first and second shingled streams into the respective first and second stacking bins thereby building another stack of signatures in the first stacking bin and building another stack of signatures in the second stacking bin.

7. The process of claim 6, wherein the unloading step is performed by:

opening the stack support member of the second stacking bin and permitting the second stack of signatures to drop onto the first stack of signatures in the first bin to form a combined stack; and then opening the stack support members of the first stacking bin to permit the combined stack to drop into the re-feeder collection bin.

8. The process of claim 6, further including:

adjusting the speed of the outfeed conveyor belt in response to the sensing step thereby settling the accumulated amount of signatures in the combined stack within the desired range during operation whereby the number of shingled signatures on the outfeed belt is substantially in balance with the combined number of incoming signatures delivered by the first and second shingled streams.

9. A process for merging first and second incoming shingled streams of signatures into a single outgoing shingled stream, comprising the steps of:

(a) providing a re-feeder including a collection bin for receiving a stack of signatures and an out-feed conveyor belt for delivering a single outgoing stream of shingled signatures;

(b) providing a stacking bin for accumulating a stack of signatures;

(c) delivering a first shingled stream of signatures into the re-feeder collection bin;

(d) delivering a second shingled stream of signatures into the stacking bin;

(e) sensing the amount of signatures accumulating in the stacking bin;

(f) interrupting delivery of signatures into both bins in response to the presence of a stack of a predetermined size in the stacking bin;

(g) unloading the contents of the stacking bin into the re-feeder collection bin to form a combined stack of signatures in the re-feeder collection bin; and, (h) resuming delivery of signatures into the stacking bin and into the re-feeder collection bin, respectively.

10. A process for combining at least two incoming shingled streams of signatures into a single outgoing shingled stream, comprising the steps of:

(a) providing a re-feeder including a collection bin mounted over a variable speed outfeed belt for delivering a single stream of shingled signatures;

(b) providing a stacking bin above and in drop alignment with the re-feeder collection bin, and separating the stacking bin from the re-feeder collection bin by an extendable and retractable stack support member;

(c) delivering a first shingled stream of signatures into the stacking bin to form a first stack of signatures;

(d) delivering a second shingled stream of signatures into the re-feeder collection bin to form a second stack of signatures;

(e) sensing the amount of signatures accumulated in the stacking bin;

(f) interrupting the delivery of signatures from the first and second shingled streams when the sensed amount of signatures in one of the bins reaches a predetermined value;

(g) opening the stack support member to permit the first stack of signatures to drop onto the second stack of signatures to form a combined stack in the re-feeder collection bin;

(h) operating the outfeed belt to remove signatures from the bottom of the stack in the re-feeder collection bin; and, (i) closing the stack support member and then resuming delivery of signatures from the first and second shingled streams into the respective bins thereby building another stack of signatures in the first stacking bin and building another stack of signatures in the re-feeder collection bin.

11. A process for merging first and second incoming shingled streams of signatures into a single outgoing shingled stream, comprising the steps of:

(a) providing a re-feeder having a collection bin mounted above a variable speed outfeed belt for delivering a single stream of shingles out of the collection bin;

(b) delivering a first shingled stream into a first stacking bin;

(c) delivering a second shingled stream into a second stacking bin;

(d) monitoring the amount of signatures in the first stacking bin;

(e) monitoring the amount of signatures in the second stacking bin;

(f) stopping the first shingled stream in response to the presence of a stack of a predetermined size in the first stacking bin;

(g) stopping the second shingled stream in response to the presence of a stack of a predetermined size in the second stacking bin;

(h) unloading the stack of signatures in the first and second stacking bins onto a first stack table and second stack table, respectively;

(i) alternately transferring the first and second signature stacks from the first and second stack tables into the collection bin of the re-feeder; and, (j) resuming delivery of signatures into the first and second stacking bins.

* * * * *